US006395119B1

(12) United States Patent
Hagedorn et al.

(10) Patent No.: US 6,395,119 B1
(45) Date of Patent: May 28, 2002

(54) IMAGE TRANSFER PROCESS AND TRANSFER SHEET FOR ELECTROSTATIC DRY TONER COPIER/PRINTER

(75) Inventors: Jürgen Hagedorn, Dreieich; Manfred Hartmann, Hanau, both of (DE)

(73) Assignee: Juergen Hagedorn, Heemstede (NL)

( * ) Notice: Subject to any disclaimer, the term of this patent is extended or adjusted under 35 U.S.C. 154(b) by 0 days.

(21) Appl. No.: 08/285,892

(22) Filed: Aug. 4, 1994

Related U.S. Application Data

(63) Continuation-in-part of application No. 07/781,258, filed as application No. PCT/EP90/01019 on Jun. 26, 1990, now abandoned.

(30) Foreign Application Priority Data

Jun. 26, 1989 (DE) ..... 32 90 864

(51) Int. Cl.[7] ..... B44C 1/65

(52) U.S. Cl. ..... 156/230; 156/240; 427/147; 427/148; 428/914

(58) Field of Search ..... 156/230, 240; 427/147, 148; 428/914

(56) References Cited

U.S. PATENT DOCUMENTS 3,516,842 A * 6/1970 Klinker et al. ..... 427/147
4,066,802 A * 1/1978 Clemens ..... 156/240
4,107,365 A * 8/1978 Reed et al. ..... 427/148
4,773,953 A * 9/1988 Hare ..... 156/240
4,980,224 A * 12/1990 Hare ..... 156/240

FOREIGN PATENT DOCUMENTS

| | | |
|---|---|---|
| DE | 3422286 | 12/1985 |
| FR | 968977 | 5/1948 |
| FR | 1334829 | 6/1962 |
| WO | 87/04393 | 7/1987 |

OTHER PUBLICATIONS

"Non–Contaminating Heat Seal Formulation", Larry R. Sagneri, Xerox Disclosure Journal.

* cited by examiner

*Primary Examiner*—Peter Chin
(74) *Attorney, Agent, or Firm*—Ostrager Chong & Flaherty LLP

(57) ABSTRACT

A transfer sheet is used for transferring an image formed by electrostatic copying to a backing of textile fabric or other porous material. The transfer sheet is composed of a plain paper substrate having no release treatment or coating applied thereto, and a transfer coating of thermoplastic polymeric film material bonded to the substrate. Transfer of the image is accomplished using only the single transfer sheet. The plain paper substrate securely retains the polymeric film coating during electrostatic imprinting and avoids contamination of the copier/printer. The image can be transferred to a textile backing by applying heat of about 160° C. and 200° C. and pressure of about 50 psi for a duration of about 5 to 10 seconds, and results in a high-quality image transfer that leaves the fabric weave open to breathe. The plain paper substrate is removed after image transfer by peeling it away from the backing while still hot.

20 Claims, No Drawings

IMAGE TRANSFER PROCESS AND TRANSFER SHEET FOR ELECTROSTATIC DRY TONER COPIER/PRINTER

This application is a continuation-in-part of U.S. patent application Ser. No. 07/781,258, filed Dec. 24, 1991, now abandone entitled "Method For Transferring Design To A Backing", by the same inventors, which is a §371 of PCT/EP90/01019, filed Jun. 26, 1990.

BACKGROUND OF THE INVENTION

The invent ion relates to a method for transferring a design such as image and text motifs to a large-area backing with porous surface, the design being transferred onto a paper and from this paper to the backing by means of heat. The invention further relates to a paper for use in this method.

To transfer motifs, for example from newspapers, personal pictures or similar in particular onto textiles such as T-shirts, the process is known of placing a paper that comprises a silicone-treated carrier paper and a rubber film laminated thereon onto a necessarily printed original design with unmodified surface in order to iron the paper onto this design. The design with the ironed-on paper is then placed in a warm soapy solution to separate it from the paper. The design is thereby transferred to the rubber film. A further paper of identical structure is then placed on the intermediate product thereby obtained in order to transfer this intermediate product onto the paper by ironing. The carrier paper is peeled off the still-hot intermediate product. Finally, the intermediate product is ironed onto the textile backing, and the carrier paper then removed from this textile backing.

A method of this type is obviously not only complicated, but also has the drawback that not every original design can be used for transfer to a textile backing. Further-more, the resultant end product feels foreign on the textile backing, since the transferred design has a rubber-like texture.

SUMMARY OF THE INVENTION

In the present invention, a transfer sheet is used for transferring an image formed by electrostatic copying to a backing of textile fabric or other porous material. The transfer sheet is composed of a substrate of plain paper without any release treatment or coating applied thereto and a transfer coating of polymeric film material bonded on a transfer side thereof. Transfer of the image is accomplished using only the single transfer sheet. The polymeric film coating remains adhered to the plain paper substrate during electrostatic copying, thereby avoiding contamination of the copier/printer. The plain paper substrate is removed after image transfer by peeling it away from the backing while still hot.

In accordance with the invention, any required original design is copied xerographically, for example, onto the paper in a dry process or transferred with thermoprinters or color thermoprinters onto the paper, in order to then transfer it without further intermediate steps directly onto the in particular textile backing, such as cotton, mixed cotton fabric or synthetic material, using pressure and heat, with complete penetration into the fibers. Accordingly, the design "imprinted" on the textile backing is not a foreign body, as with the known methods, where the transferred design has a rubber-like feel.

The backings used can also be other flat and large-area objects with porous surface such as leather, wood like plywood, or similar.

The method in accordance with the invention permits a transfer of any design onto a backing without the backing itself having to be altered in any way. Accordingly, any number of backings can be provided with the appropriate images from one and the same original design. As a result, more than one series of products can be provided with designs from the same original, which in the prior art is possible as a rule only by screen printing, i.e. by a costly manufacturing process. The designs transferred by the method in accordance with the invention fill the texture better than in screen printing, resulting in a higher quality.

DETAILED DESCRIPTION OF THE INVENTION

For an understanding of the invention, an explanation will be given of the environment in which the invention is used. Various techniques have been used for imprinting an image on a transfer sheet and transferring the image to a backing. The invention is directed to image imprinting using electrostatic dry toner copying. Prior techniques for electrostatic image imprinting have used a transfer sheet composed of a film coating carried on a release paper substrate. "Release paper" is generally known in the industry as paper treated or coated with abhesive materials like latex, wax, stearate, or silicone. Release paper was used so that it could be manually peeled off or easily separated from the transfer film coating carrying the image when the latter is applied to the backing. However, the use of release paper in electrostatic copiers creates a high risk that the film coating will become separated and contaminate the equipment. Moreover, when the film coating is released as an intact layer onto the backing, an undesirable glossy or decal-like appearance can result.

Electrostatic copiers and printers use dry toner powders instead of inks. After a toner image has been developed and transferred electrostatically to a sheet, the toner powder is fused to the sheet by a fuser roll applying pressure and heat. The size of the toner particles can range from about 11 to about 7 microns, and can be made with different melt flow indexes (MFI) for the toner resins. Depending on the size and MFI of the toner, different fusing temperatures and fusing speeds can be used. Fusing temperatures vary between 140° C. and 180° C. Fusing speed varies between 8 to 15 cm/sec. Generally, only plain paper and transparency sheets are deemed safe for use in electrostatic copiers and printers. Sandwich-type constructions using release paper as the base material would be unsafe to use because the film coating on the release paper can become separated in the copier and risk contamination of the equipment. Also, electrostatic copiers have certain limitations to the weight and thickness of sheets it can handle.

In the present invention, a transfer sheet for electrostatic dry toner imprinting of an image is composed of a plain paper substrate to which a transfer coating of polymeric film material is directly bonded. "Plain paper" is generally understood in the industry as paper product made substantially only from water, paper pulp, and fillers. The paper pulp is composed of cellulose fibers which can vary in the amount and combination of long and short fibers. If a greater amount of long fibers is used, the paper has a higher tear resistance. The plain paper substrate in this invention is not treated or coated with any release agents such as latex, wax, silicone, and the like. The transfer film coating is formed on a transfer side of the plain paper substrate by extrusion or similar means, and results in the film material becoming adhered to the fibers and within the pores of the plain paper substrate.

When this transfer sheet is run through an electrostatic copier or printer for image imprinting thereon, the transfer film coating remains adhered to and does not become separated from the plain paper substrate, thereby avoiding contamination of the equipment. Later when heat and pressure is applied to the transfer sheet with the film coating carrying the toner image placed in contact with the backing, the film coating becomes tackified and adheres to the backing, and the plain paper substrate can then be peeled away, while still hot, from the backing. This is found to result in transfer of the image without distortion. This type of transfer is similar to the so-called "hot-split transfer" in screen printing transfer methods. In the case where the backing is a fabric, it is found that the transfer film material becomes absorbed into the fabric. Due to the tackiness of the polymer film on the paper surface while still hot, the parts of the polymer film located over the holes in the fabric weave will remain adhered to the paper when it is peeled off (about 10% to 30% of the total polymer), thereby leaving the weave holes open to breathe. Leaving the weave holes open to breathe avoids the glossy or decal-like appearance of prior transfer methods on textile fabric.

Paper products with a high long fiber content are referred to as kraft paper and are used for mailing envelopes and wrapping paper. The surface texture of plain paper products can be controlled by the surface conditions of the drying cylinders or calendar rollers during papermaking. For example, a chromium-plated high gloss surface on the drying cylinders will impart a glossy surface texture. A one-sided machine-glazed white kraft paper is preferred for the plain paper substrate. Double-sided machine glazed, satinated, and other grades of plain papers may also be used. The transfer side of the plain paper should be rough enough to ensure that the film coating bonds well to the paper, and also smooth enough to allow hot-melt transfer of the film material to the backing. Generally, a smoothness of about 50 Bendtzen or more for the transfer side of the paper is found to be suitable. The tear resistance of the paper should be strong enough that the paper does not break when being peeled away from the backing.

The weight proportion of plain paper substrate to film coating can be varied depending upon the amount of polymer material required for image transfer to the backing and the sheet handling requirements of the copier. During testing, it was found that a preferred ratio of weight density of paper to polymer coating should be about 2:1 at 100% volume. "100% volume" is a term known in the industry as denoting a standard sheet thickness of 100 microns at 100 gms/m$^2$ weight density. The paper and polymer coating have quite different surface and volume charge resistivity in the electrostatic charging process and react differently to environmental conditions such as temperature and humidity. Depending on the electrostatic process conditions, it is found that a preferred total weight density for the transfer sheet is about 120 to 150 gm/m$^2$, for the paper weight density about 80 to 100 gm/m$^2$, and for the polymer film coating about 30 to 50 gm/m$^2$. The polymer coating can be any suitable type of thermoplastic film material, with polyethylene (PE) or ethylene vinyl acetate (EVA) being preferred. Depending on the toner particle size and melt flow index of the toner system, a higher amount of vinyl acetate content may be used.

When copiers with magnification or reduction options are used, there is accordingly also the possibility of altering the size between the originals and the end products. Photomontages are also feasible.

In an embodiment, the paper is cut around the outline of the intended design before the latter is placed on the backing, so that only the design is actually transferred.

The transfer of the design from the paper onto the backing is achieved by pressure and simultaneous heat application. A commercially available hot press or—for smaller designs—an iron can be used. The application pressure should be at least 50 psi (approx. $3.6\times10^5$ N/m$^2$).

When a hot press is used, it is intended that a textile backing be placed on the unheated lower platen of the hot press. The paper provided with the design is therefore placed on the heated upper platen, the latter being heated to a temperature of preferably between 160° and 200°, in particular around 180°. The temperature to be selected depends of course on the type of fabric.

With the lower and upper platens pressed together, the design on the paper is then transferred to the textile backing, virtually "pressed in", with the reaction time, i.e. the duration of pressing, being preferably 5 to 10 seconds (depending on the backing). This gives optimum results, which are reinforced when the lower platen is provided with a hard foam backing.

After the paper has been brought into contact with the backing for a pressure duration of 5 to 10 seconds and a minimum pressure of 50 psi, with a temperature of 160° to 180°, the paper is peeled off the backing while still hot.

In a proposal that is inventive per se, the paper used has a weight of approx. 90 g/sq.m. with a high proportion of long-fiber pulp. The tearing strength should be around 32 to 34 mulls (German: "Mullen" ). "Mull" or "Mullen" is a unit for measuring the tearing resistance of paper, with zero representing the lowest resistance. The term is commonly used in the paper-manufacturing industry in Europe.

"Mulls" or "Mullen" refers to a method of measuring the tearing resistance of paper, with zero representing the lowest resistance. The term is commonly used by the paper-manufacturing industry in Europe.

The paper should be coated on one side, with the coating side having approximately 50 Bentz (German: "Bentzen") and the obverse side approximately 400 to 500 Bentz. On the coating side, a 50 g/sq.m. coating of an LDPE mixture (LOW DENSITY POLYETHYLENE) is applied, preferably by extrusion. The surface of the coating has approx. 25 Bentz. "Bentz" or "Bendtzen" is a unit for measuring the smoothness of surfaces, with zero representing the maximum smoothness. The term is commonly used in the paper-manufacturing industry in Europe.

"Bentz" or "Bendtzen" refers to the smoothness of surfaces, with zero representing the maximum smoothness. The term is commonly used by the paper-manufacturing industry in Europe.

The theory in accordance with the invention can also be achieved when the design has been applied to the paper using the offset method. In a process step of this type, however, post-treatment with silicone oil is necessary.

Further details, advantages and features of the invention can be found in the following description of a preferred embodiment.

A sheet of paper comprising a 90 g/sq.m. carrier paper coated on one side with an extrusion-coated LDPE mixture of approx. 50 g/sq.m. is placed in a dry copier. A design such as a poster, picture or similar is placed on the glass plate of the copier. The design is then transferred to the paper xerographically, and can of course be either black and white or colored. The paper then has the design shown, if necessary with allowance made for any magnifications or reductions, with the design being individually modifiable by adjustment of the brightness or by color corrections.

To transfer the design to a textile backing, a hot press is used. If applicable, the paper can be cut around the outline of the design beforehand. A textile backing onto which the design is to be transferred is placed on the unheated lower platen, which has a hard foam backing. The side onto which the design is to be "printed" is of course facing the upper platen. The paper with the design is then placed on the backing. The upper platen of the hot press is heated to a temperature of preferably 180°. The press is then closed and maintained at a high pressure (at least 50 psi) for a duration of about 10 seconds. When the press is opened, the carrier paper, which is still hot, is peeled off. The finished product is now removed. The transferred design feels like an integral part of the textile backing, since the design has penetrated completely into the fibers of the textile.

When small designs are transferred, with a size of 15 cm×20 cm, for example, an iron can be used, otherwise with the same process steps as described above.

What is claimed is:

1. A method for transferring an image onto a backing of textile fabric comprising the steps of:

providing a transfer sheet consisting essentially of a substrate of plain paper only without any release treatment or coating applied thereto, and a transfer coating of thermoplastic polymeric film material bonded on a transfer side of the plain paper substrate;

forming a toner image on said transfer sheet in an electrostatic dry toner copier/printer by dry toner developing and fusing onto the polymeric film coating of the transfer sheet and without applying any adhesive overcoating or solvent layer thereon; and transferring the toner image to the backing of textile fabric by placing the polymeric film coating against the textile fabric and applying suitable heat and pressure for a sufficient time to an obverse side of the transfer sheet until the polymeric film material becomes tackified and adheres to the backing of textile fabric sufficiently to allow the plain paper substrate to be stripped away therefrom.

2. A method for transferring an image to a backing according to claim 1, wherein the toner image is transferred to the backing of textile fabric by the application of heat of about 160° C. to 200° C. and pressure of at least 50 psi in the transferring step.

3. A method for transferring an image to a backing according to claim 2, wherein the time of application of heat and pressure in the transferring step is about 5 to 10 seconds.

4. A method for transferring an image to a backing according to claim 1, wherein the plain paper substrate has a surface smoothness on the transfer side of about 50 Bendtzen or more and a weight density of about 80 to 100 gm/m$^2$, the polymer film coating has a weight density of about 30 to 50 gm/m$^2$, and the transfer sheet has a total weight density of about 120 to 150 gm/m$^2$.

5. A method for transferring an image to a backing according to claim 1, wherein the plain paper substrate is machine-glazed kraft paper and the polymeric film material is ethyl vinyl acetate (EVA).

6. A method for transferring an image to a backing according to claim 1, wherein in said transferring step the plain paper substrate is peeled from the backing while still hot after the polymeric film coating becomes tackified and adheres to the backing.

7. A transfer sheet for use in imprinting a toner image thereon by electrostatic dry toner developing and fusing thereon and thereafter transferring the toner image to a backing of textile fabric, consisting essentially of:

a substrate of plain paper only without any release treatment or coating applied thereto, and a transfer coating of thermoplastic polymeric film material bonded on the transfer side of the plain paper substrate, wherein said plain paper substrate and said polymeric film coating are selected such that an image can be formed by dry toner developing and fusing onto the polymeric film coating in an electrostatic dry toner copier/printer without separation of the film coating from the substrate and contamination of the copier/printer and transferred to the backing of textile fabric, without any overprint adhesive or solvent layer thereon, by application of heat and pressure for a sufficient time to an obverse side of the transfer sheet until the polymeric film material becomes tackified and adheres to the backing of textile fabric sufficiently to allow the plain paper substrate to be stripped away therefrom.

8. A transfer sheet according to claim 7, wherein the plain paper substrate has a surface smoothness on the transfer side of about 50 Bendtzen or more.

9. A transfer sheet according to claim 7, wherein the plain paper substrate has a tear resistance of about 32 to 34 Mullen.

10. A transfer sheet according to claim 7, wherein the plain paper substrate is one selected from a group consisting of one-sided machine-glazed paper, double-sided machine glazed paper, and satinated plain paper.

11. A transfer sheet according to claim 7, wherein the polymeric film material is low density polyethylene (LDPE).

12. A transfer sheet according to claim 7, wherein the polymeric film material is ethylene vinyl acetate (EVA).

13. A transfer sheet according to claim 7, having a total weight density of about 120 to 150 grams/m$^2$.

14. A transfer sheet according to claim 7, wherein the plain paper substrate and the polymeric film coating have a ratio of weight densities of approximately 2:1.

15. A transfer sheet according to claim 7, wherein the plain paper substrate has a weight density of about 80 to 100 grams/m$^2$ and the polymeric film coating has a weight density of about 30 to 50 grams/m$^2$.

16. A transfer sheet according to claim 7, wherein the polymeric film coating is formed as an extruded film on the plain paper substrate.

17. A transfer sheet according to claim 7, wherein the polymeric film coating has a surface smoothness on the transfer side of about 25 Bendtzen.

18. A transfer sheet according to claim 7, wherein the plain paper substrate is made of both long and short cellulose fibers and the proportion of long fibers is about 50% to 80% of the total fiber quantity.

19. A transfer sheet according to claim 7, wherein the transfer side of the plain paper substrate has a surface smoothness of about 50 Bendtzen and the obverse side has a surface smoothness of about 400 to 500 Bendtzen.

20. A transfer sheet according to claim 7, wherein the plain paper substrate is a one-sided machine-glazed white kraft paper having a high long-fiber content.

* * * * *